US006343381B1

(12) United States Patent
Sirakova

(10) Patent No.: US 6,343,381 B1
(45) Date of Patent: Feb. 5, 2002

(54) BODY GARMENT

(76) Inventor: Zlatka Viola Sirakova, 200 Park Street, South Melbourne, Victoria 3205 (AU)

( * ) Notice: Subject to any disclaimer, the term of this patent is extended or adjusted under 35 U.S.C. 154(b) by 0 days.

(21) Appl. No.: 09/601,770

(22) PCT Filed: Feb. 5, 1999

(86) PCT No.: PCT/AU99/00072

§ 371 Date: Aug. 4, 1999

§ 102(e) Date: Aug. 4, 1999

(87) PCT Pub. No.: WO99/39596

PCT Pub. Date: Aug. 12, 1999

(30) Foreign Application Priority Data

Feb. 6, 1998 (AU) ..... PP 1723

(51) Int. Cl.[7] ..... A41B 1/00
(52) U.S. Cl. ..... 2/69; 2/243.1
(58) Field of Search ..... 2/243.1, 69, 114–115, 2/113, 85, 93, 94, 80, 83, 105, 106, 74–76

(56) References Cited

U.S. PATENT DOCUMENTS

| | | | | |
|---|---|---|---|---|
| 4,097,933 A | | 7/1978 | de Polo | |
| 4,176,408 A | * | 12/1979 | de Polo | 2/69 |
| 4,368,547 A | | 1/1983 | de Polo | |
| 4,586,198 A | * | 5/1986 | Alaniz | 2/105 |

FOREIGN PATENT DOCUMENTS

| | | |
|---|---|---|
| FR | 2601564 | 1/1988 |
| GB | 2212709 | 8/1989 |
| WO | 9715204 | 5/1997 |

* cited by examiner

*Primary Examiner*—Gloria M. Hale
(74) *Attorney, Agent, or Firm*—Edwin D. Schindler

(57) ABSTRACT

Garments and methods for making those garments by cutting a woven fabric along a bias (6) and then seaming (9) the fabric parallel to the actual grain (5) of the fabric thus forming a tubular or conical shaped garment. This method can be used in a variety of garments such as dresses and skirts.

16 Claims, 7 Drawing Sheets

Figure 1:
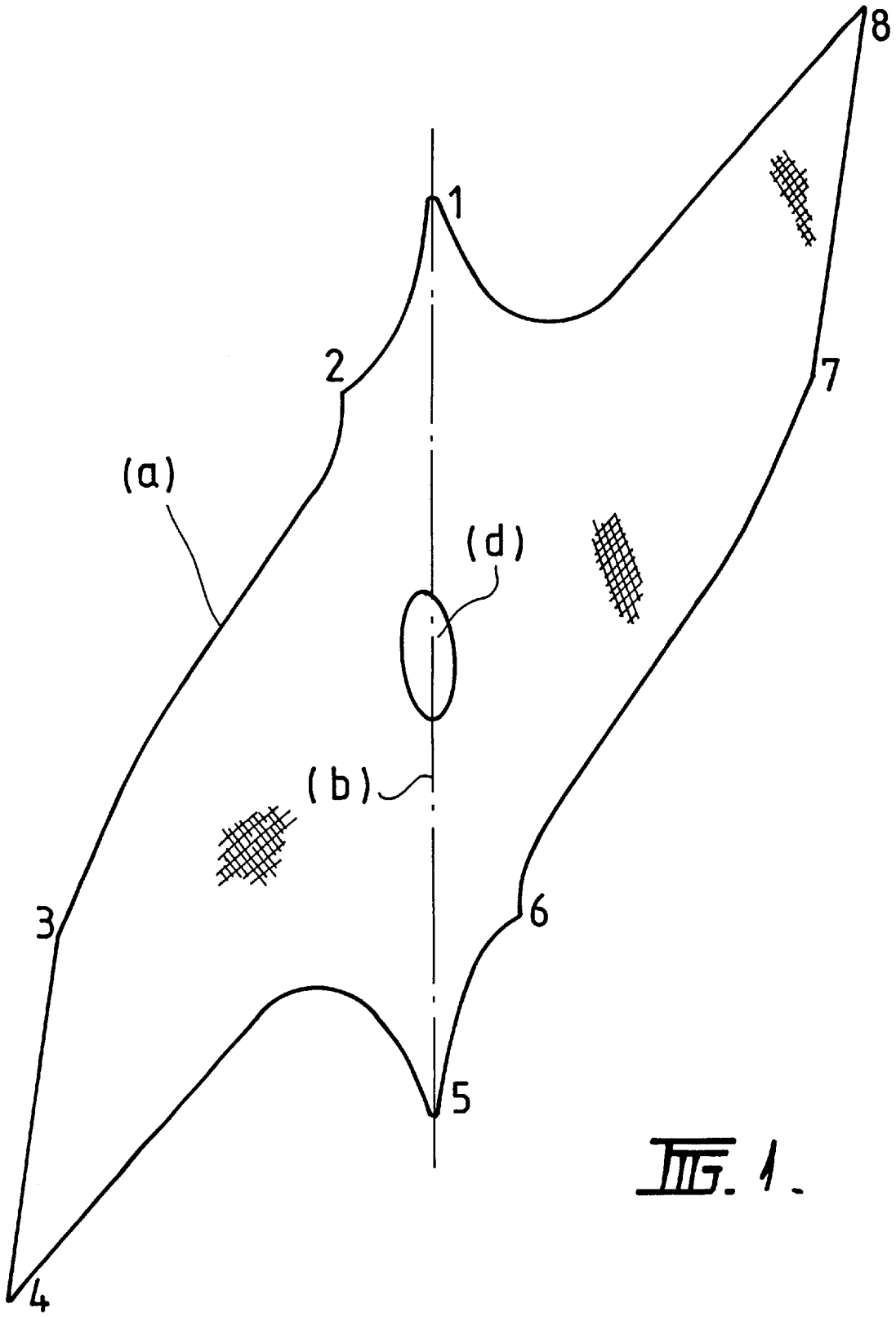

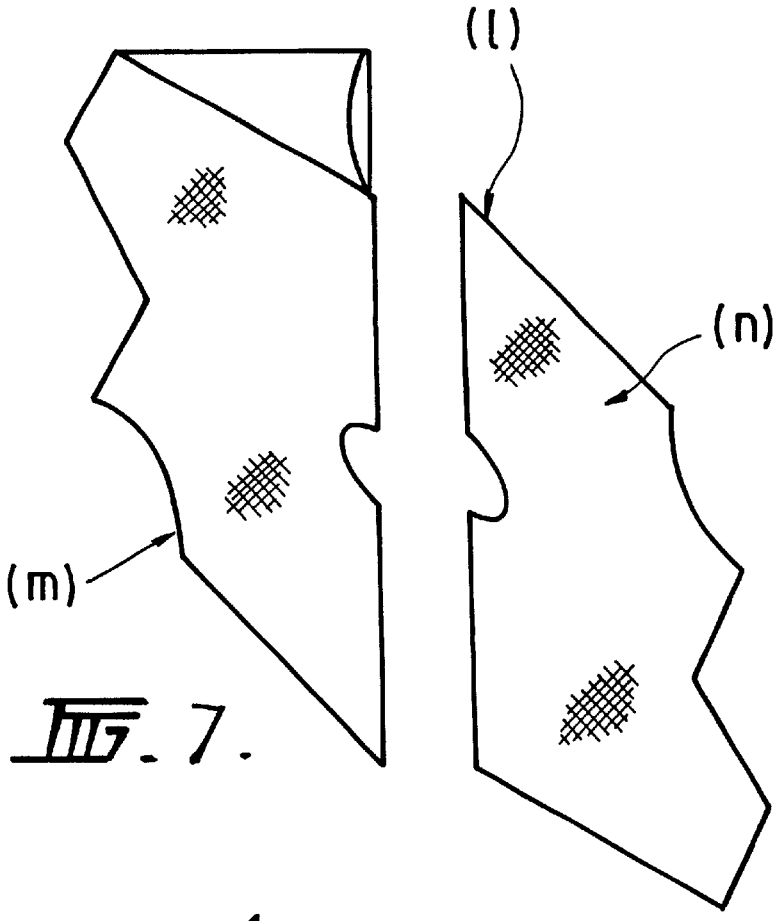
FIG. 7.
FIG. 8.
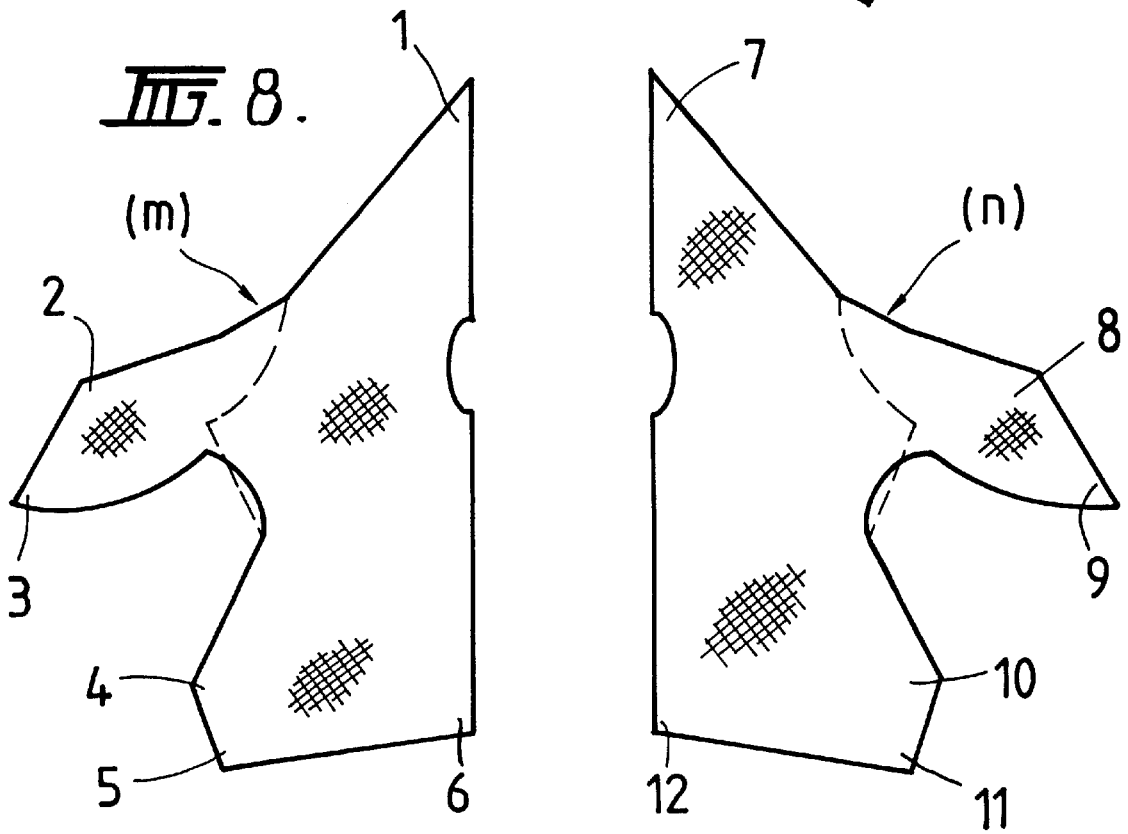

BODY GARMENT

This invention relates to a body garment, particularly a body garment which allows for the unrestrained movement of the human arm.

Many body garments, particularly those with sleeves, have seams that run from the nape of the neck and along the shoulder line on both sides of the body as most upper body garments come in two parts, a front and a rear part, and are usually seamed along the shoulder line. Some upper body garments with sleeves have a further seam, as a result of the attachment of the sleeves on respective sides of the garment to the body of the garment.

It is a combination of these seams which impedes the free movement of the arms, from the shoulder joint.

Those people who would benefit from unrestricted movement of the arms when wearing a body garment with sleeves attached thereto are in particularly those which participate in racquet sports, such as tennis, squash and badminton or those which play other sports which require unrestricted arm movement such as golf or cricket.

It is often noticed that many sportsmen and women, particularly those which play tennis, tend to wear loose t-shirts or polo shirts and lift the sleeves of their t-shirt or polo shirts most often, when they are about to serve the tennis ball, so as to gain as maximum an amount of unrestricted arm movement as the t-shirt or polo shirt which they wear permits. Though this is often done in an attempt to gain as maximum an amount of arm movement in a desired direction as possible, it is neither practical nor entirely effective.

It is the object of this invention to provide a body garment, which enables unrestricted movement of the arm in any desired direction.

According to the invention, there is provided a body garment, said garment including a single formed fabric which is folded along its central axis, and further folded and seamed, said seams running diagonally across the front and rear of said garment, with the respective ends of the essentially formed garment, being wrapped around and seamed, so that the garment has a t-shaped appearance, there being, an aperture created through the central top portion of the garment through which an individual's head is to be passed when the garment is to be worn.

In a further aspect of the invention, the upper portion of the single formed fabric is adapted to provide a single further formed fabric which with the mirror image of the adapted single formed fabric is joined together so as to create a first central seam, the joined fabric is subsequently folded and further seamed such that the substantially formed body garment incorporates seams which spiral from each end of the sleeve of the body garment and run diagonally from the front end of each respective side of the body garment, meeting at and intersecting the central seam.

In order that the invention may be readily understood, we shall describe, with the aid of accompanying drawings, a preferred embodiment of the invention, and further embodiments of the invention by way of non-limiting example.

In these drawings:

FIG. 1. Is a representation of the formed fabric for a preferred embodiment of a body garment.

Figure 2:
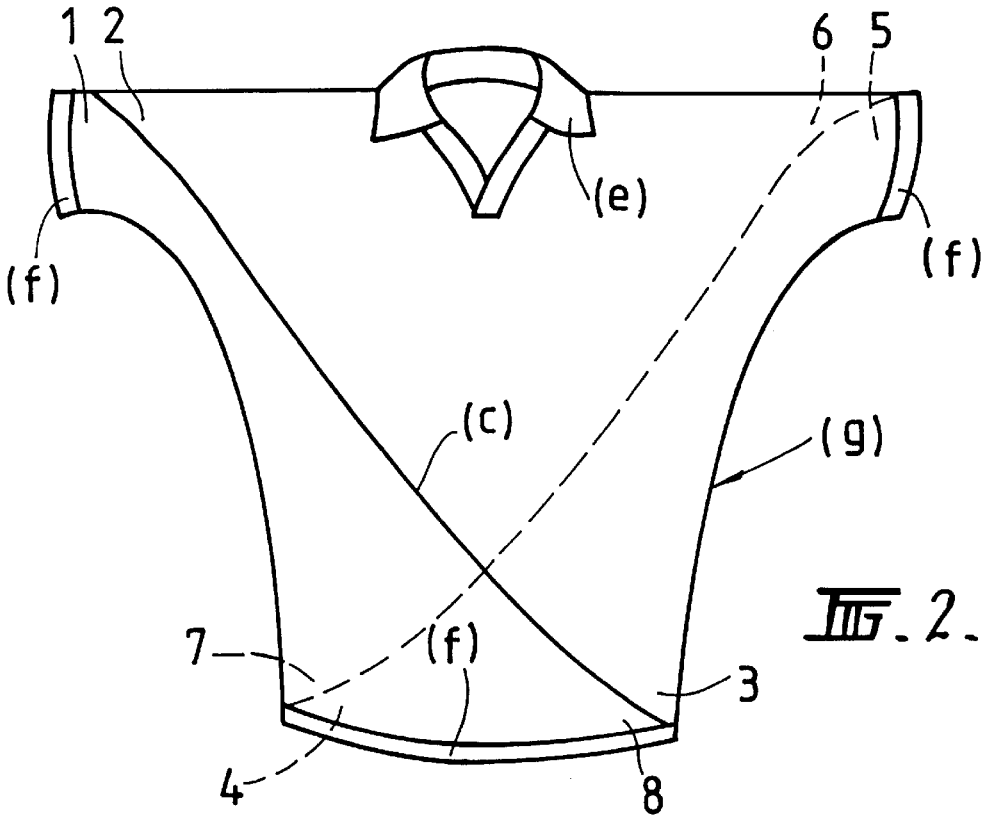

FIG. 2. Is a front view of a preferred embodiment of a body garment.

Figure 3:
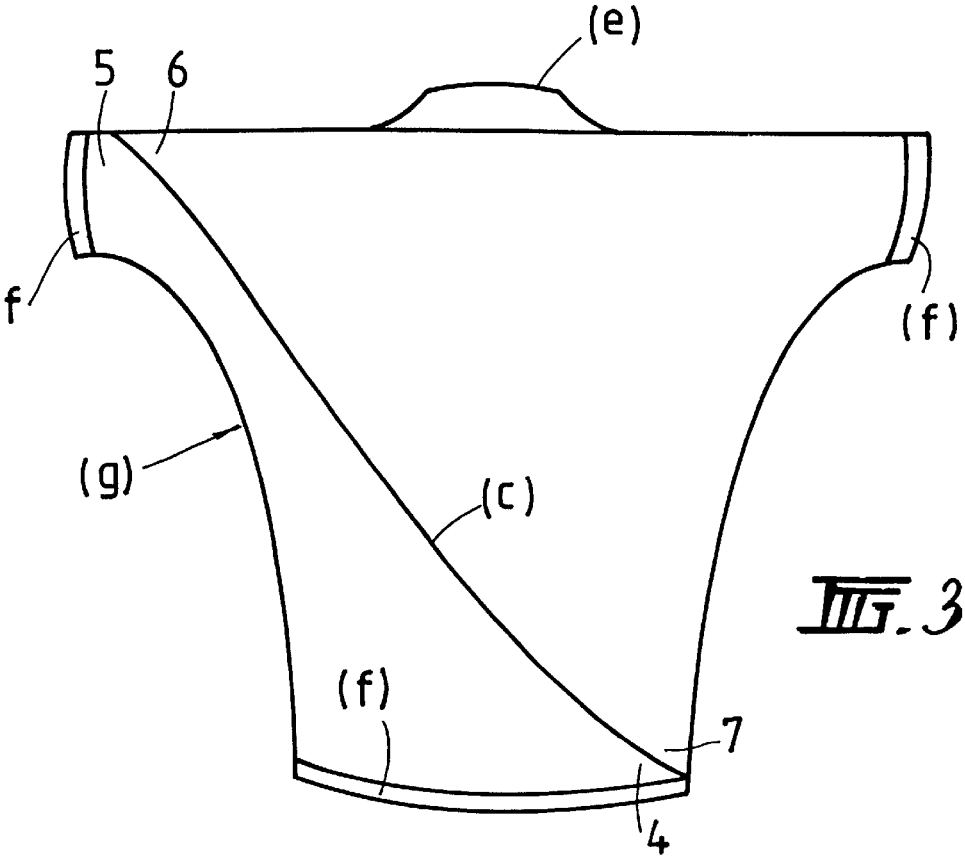

FIG. 3. Is a rear view of a preferred embodiment of a body garment.

Figure 4:
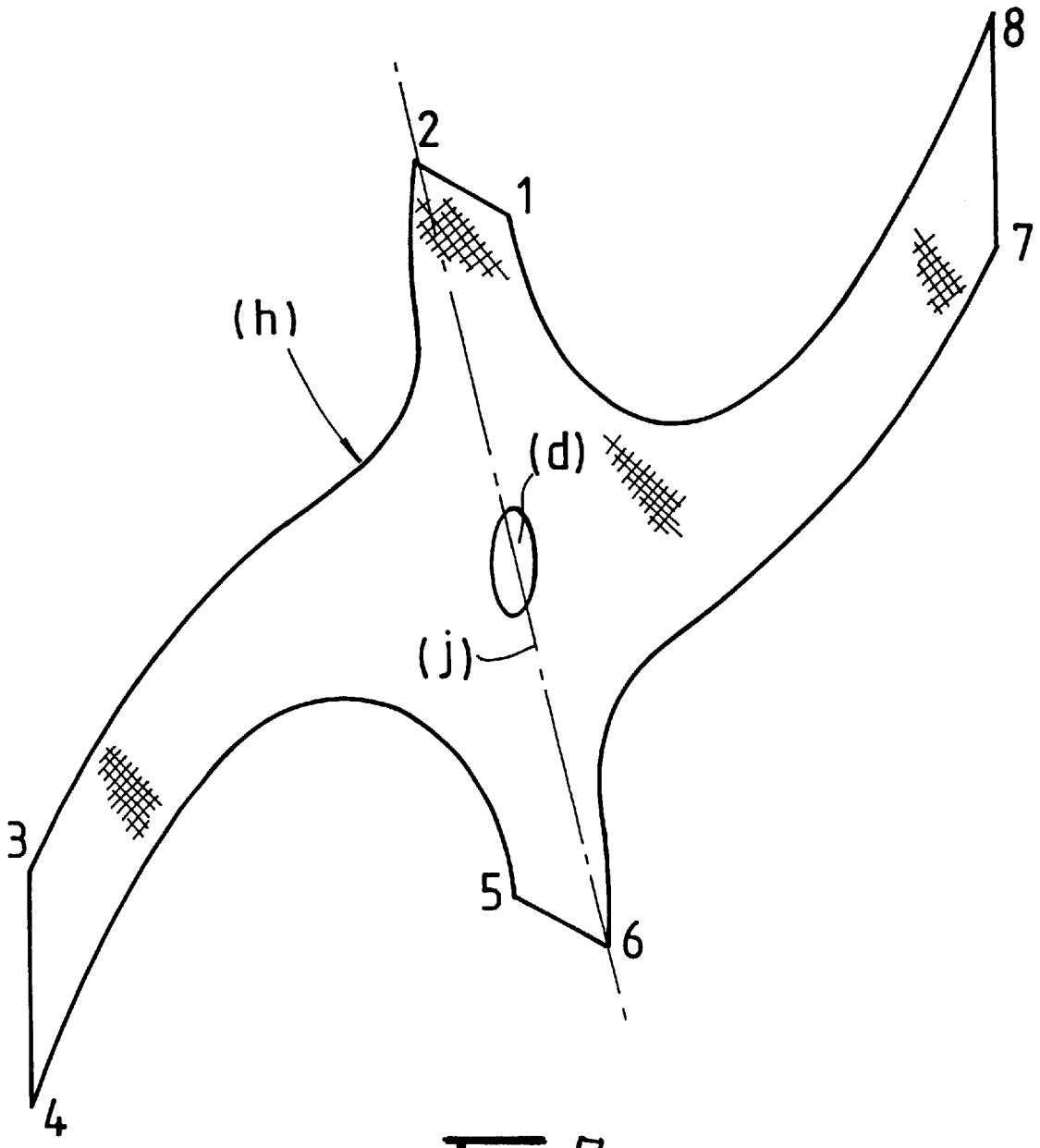

FIG. 4. Is a representation of a formed fabric for a further embodiment of a body garment.

Figure 5:
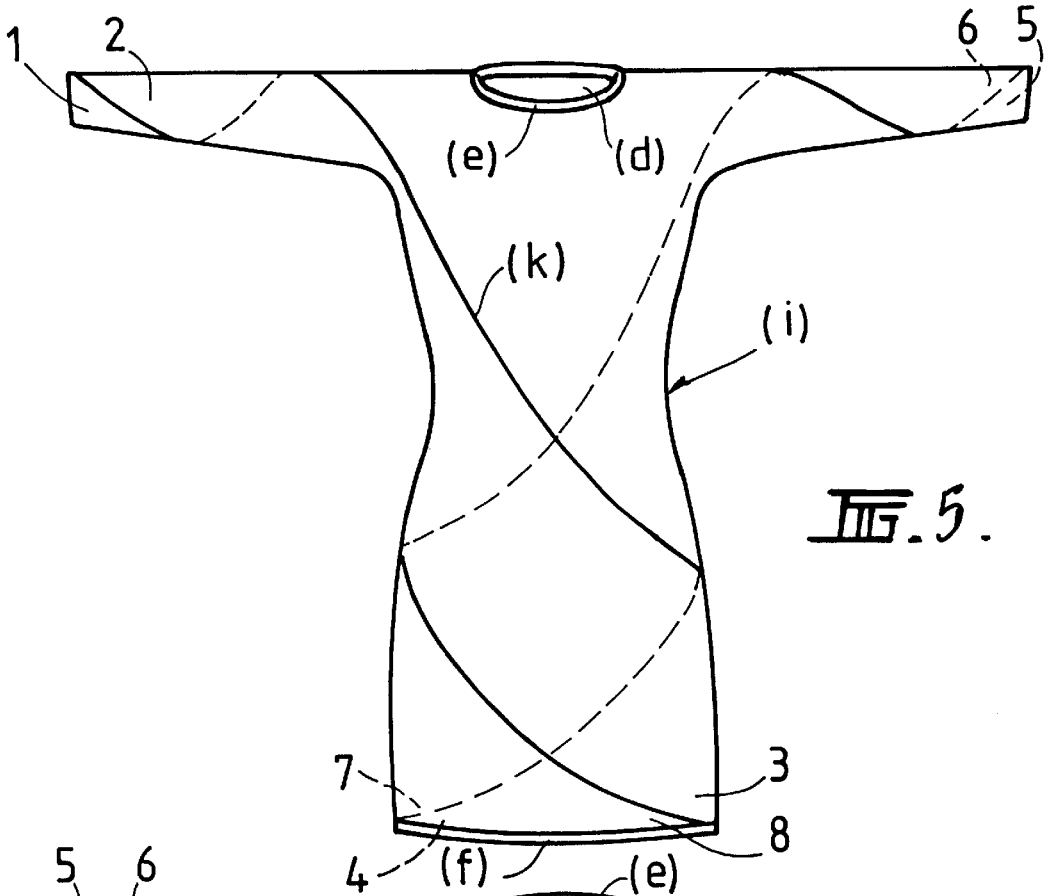

FIG. 5. Is a front view of a further embodiment of a body garment.

Figure 6:
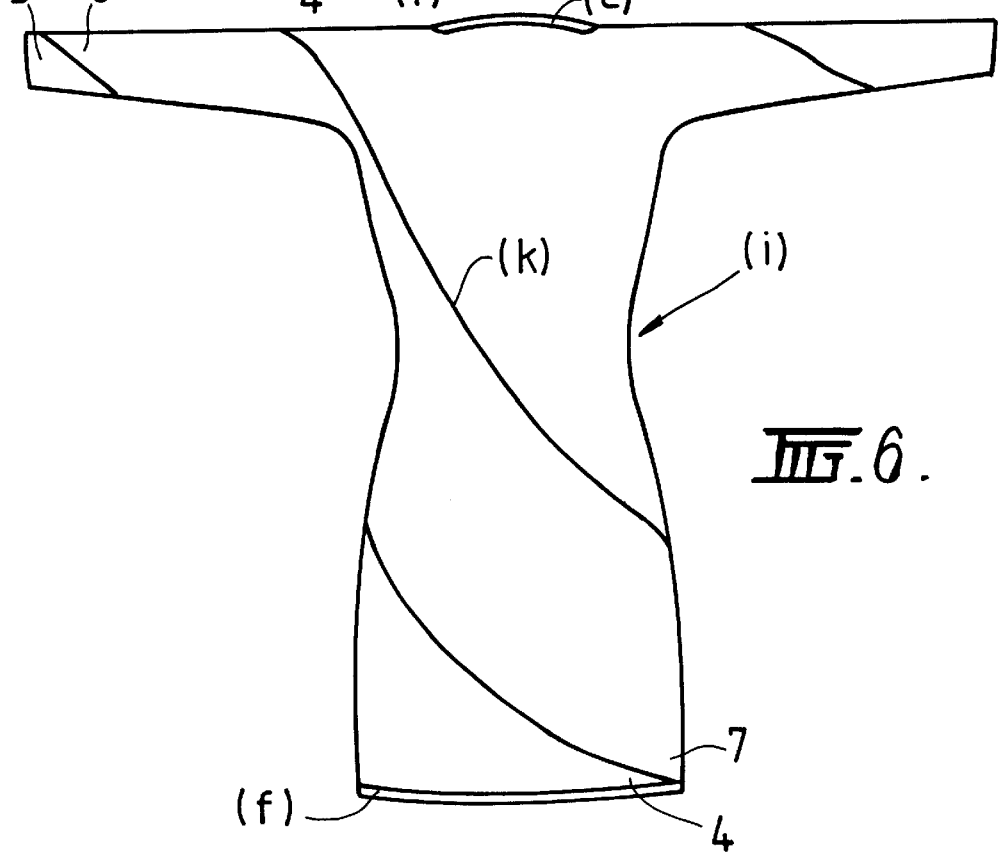

FIG. 6. is a rear view of a further embodiment of a body garment.

FIG. 7. Is a representation of an adaptation of the originally formed fabric.

FIG. 8. Is a representation of the adaptation of the original formed fabric and its mirror image for a short sleeved and long sleeved body garment.

Figure 9:
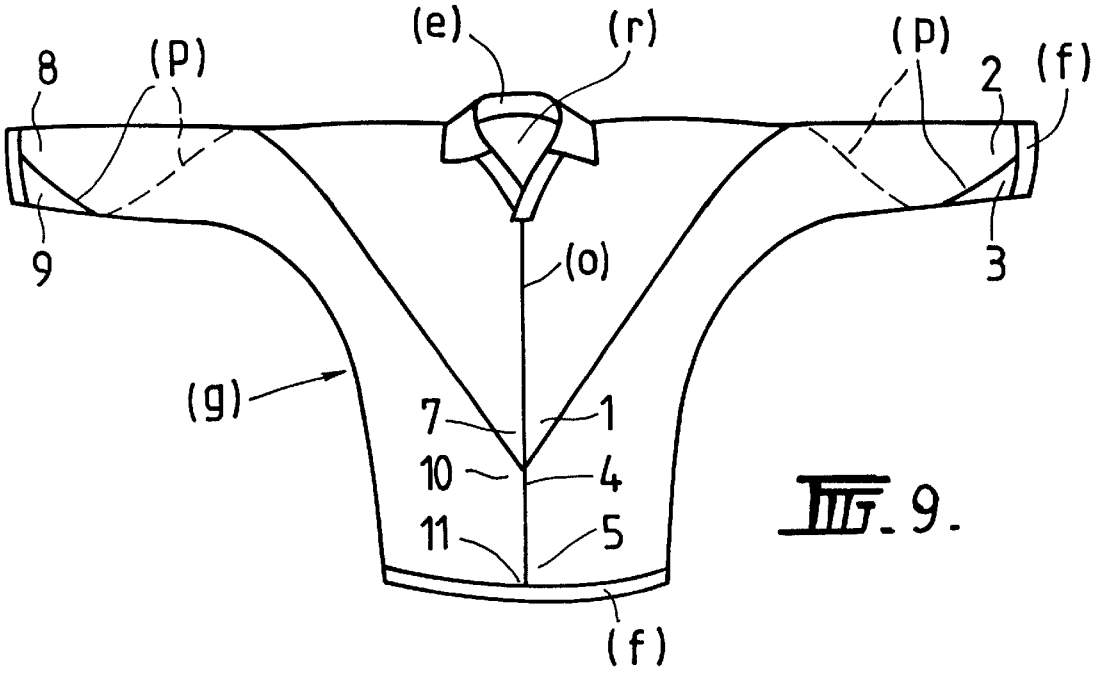

FIG. 9. Is a front view of the further aspect of the invention which constitutes the adaptation of the original formed fabric and its mirror image folded and seamed.

Figure 10:
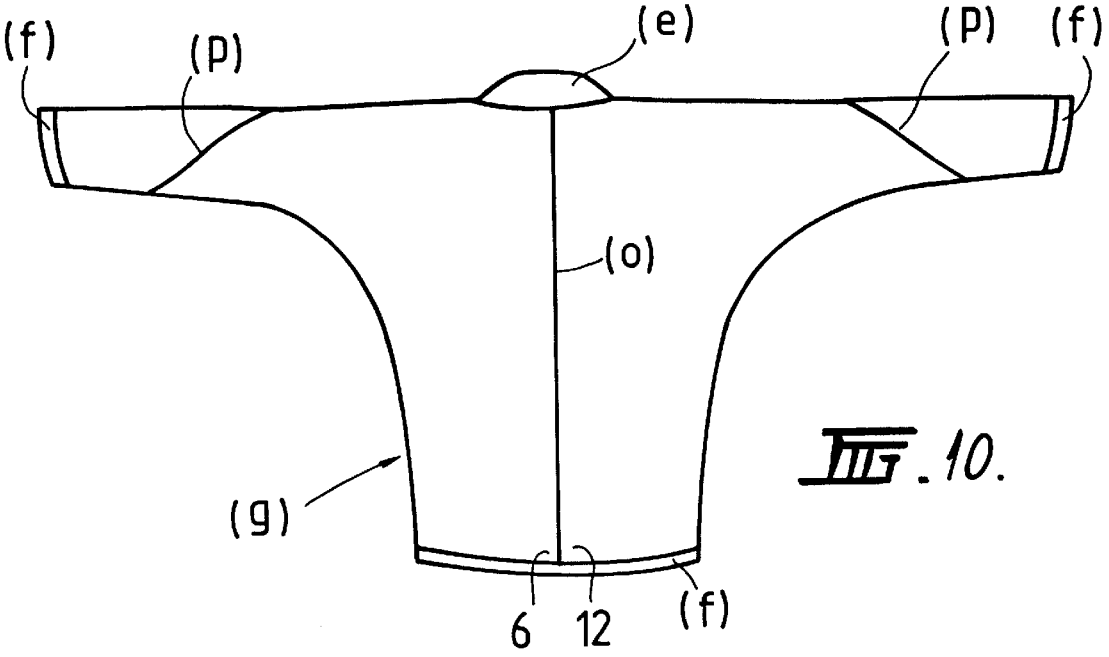

FIG. 10. Is a rear view of the further aspect of the invention which constitutes the adaptation of the original formed fabric and its mirror image folded and seamed.

Figure 11:
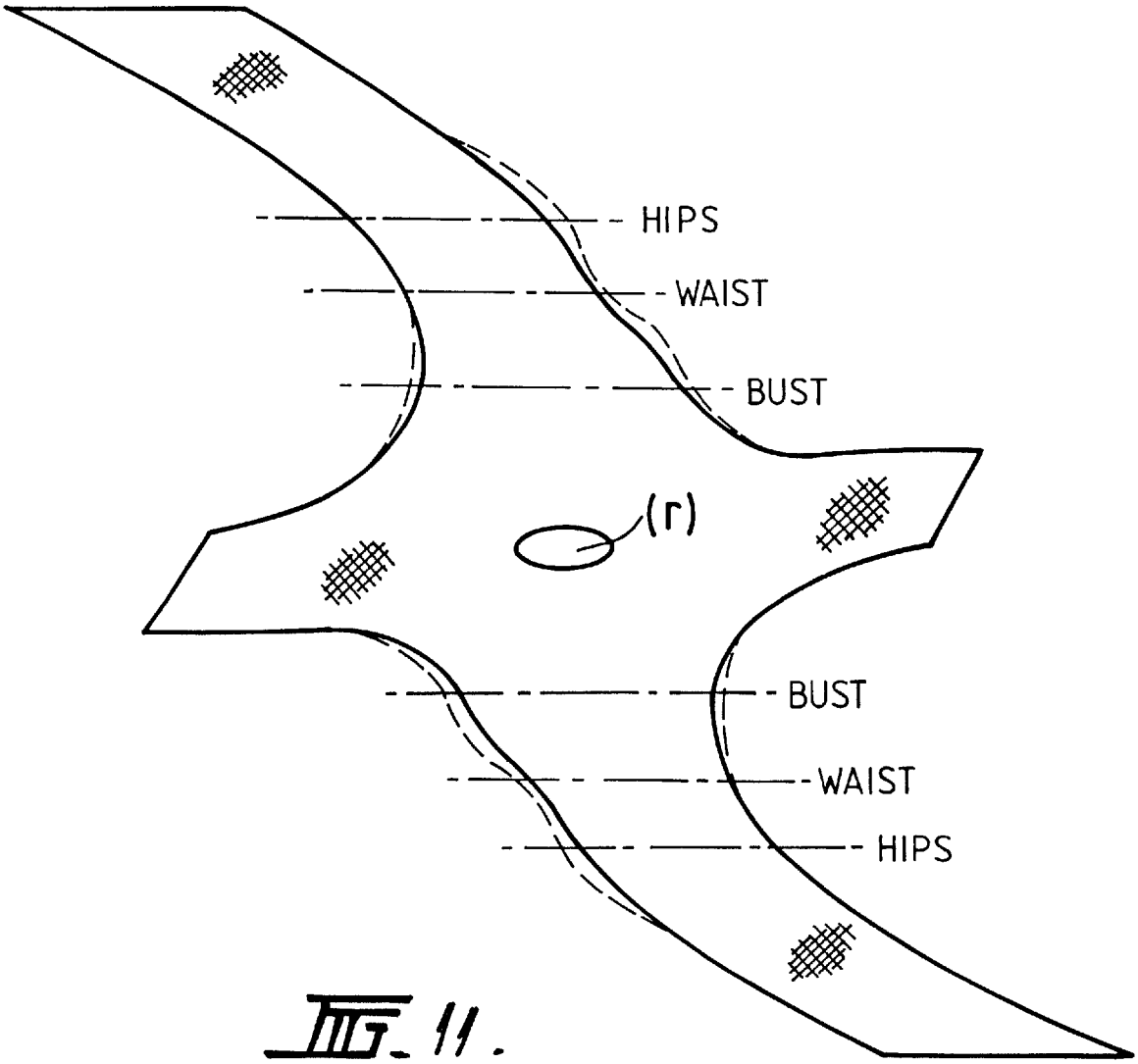

FIG. 11. Is a representation of a formed fabric which shows the shaping the fabric takes so as to accommodate the human form.

In a preferred embodiment of the invention, the body garment comprises a single formed fabric(a) as in FIG. 1, with various points (1–8) along the fabric connecting as shown in FIGS. 2 and 3 so as to form the body garment(g). The formed fabric is firstly folded along its central axis(b), and further folded and seamed so that the seams(c) run diagonally across the front and rear of the now essentially formed garment from a position beginning near the proximity of the arm hole. As these seams run diagonally across the body, there is no restriction of arm movement in any desired direction. The respective ends of the essentially formed garment are wrapped around and seamed, so that the garment(g) has an essentially T-type appearance, as shown in FIGS. 2 & 3. The garment(g) is provided with an aperture(d) at what is the central top portion of the garment (g), said aperture(d) enabling the garment to be passed over a person's head.

The seams which run diagonally across the body of the body garment run from left to right when the single formed fabric as shown in FIG. 1 is utilised however if a mirror image of the single formed fabric is utilised, the seams which run diagonally across the front and rear of the body garment run from right to left.

To the body garment may be added a collar(e) and bands(f) around the sleeves and bottom of the garment as well as other decorative features so that the garment has essentially a polo shirt appearance.

In a further embodiment, the body garment includes a single formed fabric(h) as shown in FIG. 4 with various points(1–8) along the fabric connecting as shown in FIGS. 5 and 6 so as to form the body garment(i). The formed fabric(h) is firstly folded along its central axis(j), and further folded and seamed so that the seams(k) run diagonally across the front and back of the now essentially formed garment. As these seams run diagonally across the body, there is once again no restriction of arm movement in any desired direction. The respective ends of the essentially formed body garment are wrapped around and seamed, so that the body garment(i) has the appearance of a dress of desired length depending on the length of the formed fabric(h), as shown in FIGS. 5 & 6. The body garment(i) is provided with an aperture(d) at what is the central top portion of the garment(i), said aperture(d) enabling the garment to be passed over a person's head. To the garment may be added a collar(e) and bands(f) around the sleeves and bottom of the garment as well as other decorative features. The shaping of the garment(i) is further determined by the bust waist and hip measurements of individuals as shown in FIG. 11.

In a further aspect of the invention, either a short or long sleeved body garment(l), is derived from an adaptation of an upper or lower, portion of the originally formed fabric(a), such adaptation of the originally formed fabric(m) being illustrated in FIG. 7 and its mirror image(n).

The adaptation of the formed fabric(m) and its mirror image(n) as shown in FIG. 8 have various points around the perimeter of both the formed fabric(m) and its mirror image(n)–(1–12). The formed fabric(m) and its mirror image(n) are then sewn together so as to create a central seam(o). The joined fabric is subsequently folded and further seamed such that the substantially formed body garment incorporates seams(p) which spiral from each end of the sleeve of the body garment and run diagonally from the front end of each respective side of the body garment(q), meeting at and intersecting the central seam(o) and the formed garment(q) has an aperture(r) incorporated therein, so that the garment may pass over an individual's head.

The formed body garment(q) once again has essentially a T-shape type appearance which is either long sleeved or short sleeved, depending on the length of the formed fabric.

To alter the orientation of the formed garment so that the front of the body garment described herein above becomes the rear of the body garment, the orientation of the neckline is altered.

Once again to the body garment(q) FIGS. 9 and 10, may be added a collar(e) and bands(f) around the sleeves and bottom of the body garment as well as other decorative features so that the garment has essentially a polo shirt appearance which is either short or long sleeved.

The body garments described herein above may be made of any type of fabric, however, the shaping of the formed fabric is varied according to the grain of the fabric and the type of fabric which is utilised.

It is envisaged that other embodiments of the invention will exhibit any number of and any combination of the features of the previously described embodiments.

Whilst we have described herein specific preferred embodiments of the invention it is to be understood that variations and modifications in this can be made without departing from the scope thereof.

The claims defining the invention are as follows:

1. A body garment, comprising a first piece of fabric and a second piece of fabric, said second piece of fabric shaped in a mirror image of said first piece of fabric so that when said first piece of fabric and said second piece of fabric are joined along a first central seam, subsequently folded along an axis and further seamed, said body garment incorporates seams which spiral from each end of a sleeve of said body garment and run diagonally from opposing sides of said body garment and meet at, and intersect, said first central seam, said body garment having an aperture through which a wearer's head would be passable when said body garment is worn.

2. The body garment according to claim 1, wherein a front side and a rear side of said body garment is determined by the shape of the aperture of said body garment.

3. The body garment according to claim 1, wherein said body garment has a shape dependent upon grain and type of fabric utilized, whereby the manner in which the fabric is cut determines stretchability of said body garment and, in turn, size and shape of components of said body garment.

4. The body garment according to claim 1, wherein said fabric utilized is a durable, flexible material.

5. A body garment, comprising a single piece of fabric and having a first shape, so that when said fabric is folded about a central axis, a first side having edges and a second side having edges are formed, said edges of the first side and said edges of the second side being seamed together with seams running diagonally across a front side and a rear side of said body garment, said body garment having an aperture through which a wearer's head would be passable when said body garment is worn.

6. The body garment according to claim 5, wherein said seams run diagonally from left to right.

7. The body garment according to claim 5, wherein said seams run diagonally from right to left when said body garment is formed from a piece of fabric having a shape which is a mirror image of said first shape.

8. The body garment according to claim 5, wherein said single piece of fabric has a shape determined by bust waist and hip measurements of a wearer.

9. The body garment according to claim 8, wherein the aperture through which the wearer's head is passable is formed as a collar.

10. The body garment according to claim 8, wherein the aperture through which the wearer's head is passable is formed as a decorative neckline.

11. The body garment according to claim 5, wherein said body garment is a T-shirt.

12. The body garment according to claim 5, wherein said body garment is a polo shirt.

13. The body garment according to claim 5, wherein said body garment is a body shirt.

14. The body garment according to claim 5, wherein said body garment is a dress.

15. The body garment according to claim 5, wherein said body garment has a shape dependent upon grain and type of fabric utilized, whereby the manner in which the fabric is cut determines stretchability of said body garment and, in turn, size and shape of components of said body garment.

16. The body garment according to claim 15, wherein said fabric utilized is a durable, flexible material.

* * * * *